US010643519B2

(12) United States Patent
Lee et al.

(10) Patent No.: US 10,643,519 B2
(45) Date of Patent: May 5, 2020

(54) METHOD AND APPARATUS OF GRAYSCALE IMAGE GENERATION IN MONOCHROME DISPLAY

(71) Applicant: Solomon Systech (Shenzhen) Limited, Shenzhen (CN)

(72) Inventors: Chi Wai Lee, Hong Kong (HK); Chun Hung Lai, Hong Kong (HK); Wai Hon Ng, Hong Kong (HK); Yuen Pat Lau, Hong Kong (HK); Ling Sum Leung, Hong Kong (HK)

(73) Assignee: Solomon Systech (Shenzhen) Limited, Shenzhen (CN)

( * ) Notice: Subject to any disclaimer, the term of this patent is extended or adjusted under 35 U.S.C. 154(b) by 111 days.

(21) Appl. No.: 15/657,310

(22) Filed: Jul. 24, 2017

(65) Prior Publication Data

US 2019/0027084 A1 Jan. 24, 2019

(51) Int. Cl.
*G09G 3/20* (2006.01)
*G09G 3/3216* (2016.01)
(Continued)

(52) U.S. Cl.
CPC ..... *G09G 3/2018* (2013.01); *G09G 3/04* (2013.01); *G09G 3/3216* (2013.01); *G09G 5/391* (2013.01); *G09G 2310/04* (2013.01); *G09G 2310/06* (2013.01); *G09G 2310/08* (2013.01); *G09G 2320/064* (2013.01);
(Continued)

(58) Field of Classification Search
CPC .... G09G 3/2018; G09G 3/3216; G09G 5/391; G09G 3/04; G09G 2310/08; G09G 2310/06; G09G 2310/04; G09G 2320/064; G09G 2340/0407; G09G 2340/08; G09G 2360/18
See application file for complete search history.

(56) References Cited

U.S. PATENT DOCUMENTS 6,339,422 B1 * 1/2002 Kuwajima ..... G09G 3/3622 345/204
7,944,410 B2 5/2011 Smith et al.
(Continued)

OTHER PUBLICATIONS

Search Report of Taiwan Patent Application No. 10720199690 dated Mar. 7, 2018.

*Primary Examiner* — Kwang-Su Yang
(74) *Attorney, Agent, or Firm* — Idea Intellectual Limited; Margaret A. Burke; Sam T. Yip

(57) ABSTRACT

A method is provided that allows the use of monochrome PMOLED display driver to generate grayscale patterns without the need to change the resolution of the 1-bit digital-to-analog converter (DAC) on the data line (SEG). The method further allows the elimination of extra frame buffer display memory needed by conventional techniques. This is achieved by swapping display memory space for display image pixel color (grayscale) depth in the expense of display resolution. The method further allows grayscale pattern data to be written into frame buffer only once without additional control from the host controller. The method further allows the dynamic application of grayscale on selectable whole or portion of a scan line such that full grayscale image display or a mixture of monochrome and grayscale image display in a single display panel is possible.

17 Claims, 12 Drawing Sheets

(51) Int. Cl.
*G09G 5/391* (2006.01)
*G09G 3/04* (2006.01)

(52) U.S. Cl.
CPC . *G09G 2340/0407* (2013.01); *G09G 2340/08* (2013.01); *G09G 2360/18* (2013.01)

(56) References Cited

U.S. PATENT DOCUMENTS

| | | | | |
|---|---|---|---|---|
| 8,115,704 | B2 | 2/2012 | Smith et al. | |
| 8,237,635 | B2 | 8/2012 | Smith et al. | |
| 2008/0211793 | A1 | 9/2008 | Ku | |
| 2009/0225106 | A1* | 9/2009 | Kim | G09G 3/3648 345/691 |
| 2013/0050299 | A1 | 2/2013 | Yoshinaga | |
| 2016/0093260 | A1* | 3/2016 | Watsuda | G09G 3/3688 345/87 |

* cited by examiner

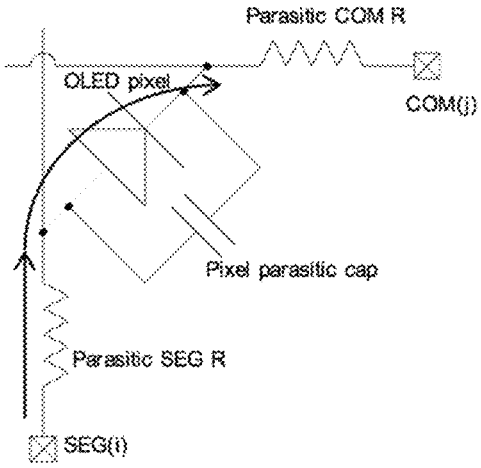
FIG. 1a – Prior Art
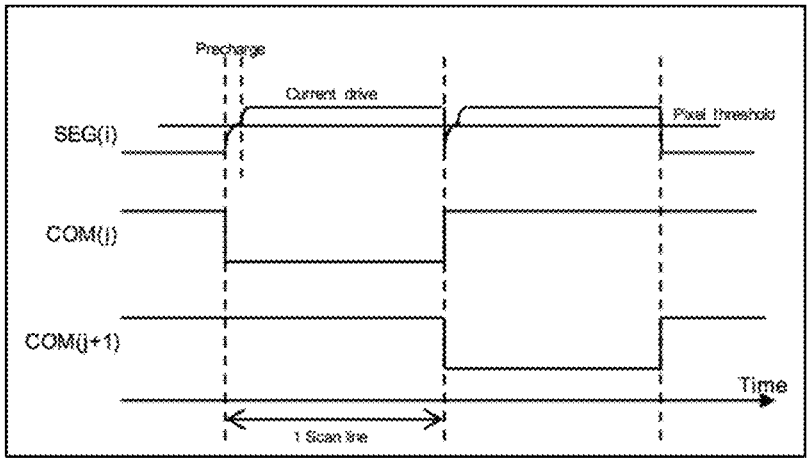
FIG. 1b – Prior Art

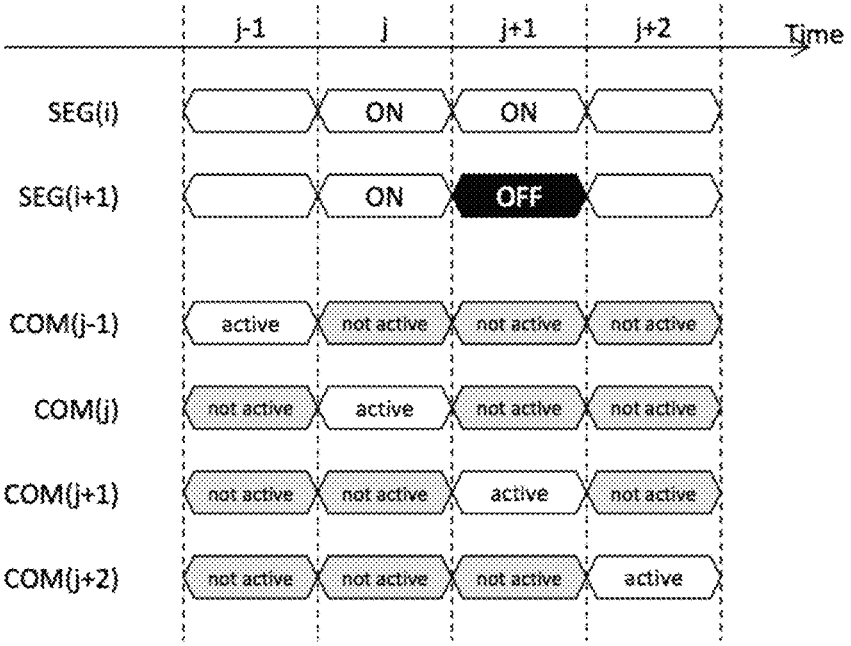
FIG. 2a – Prior Art
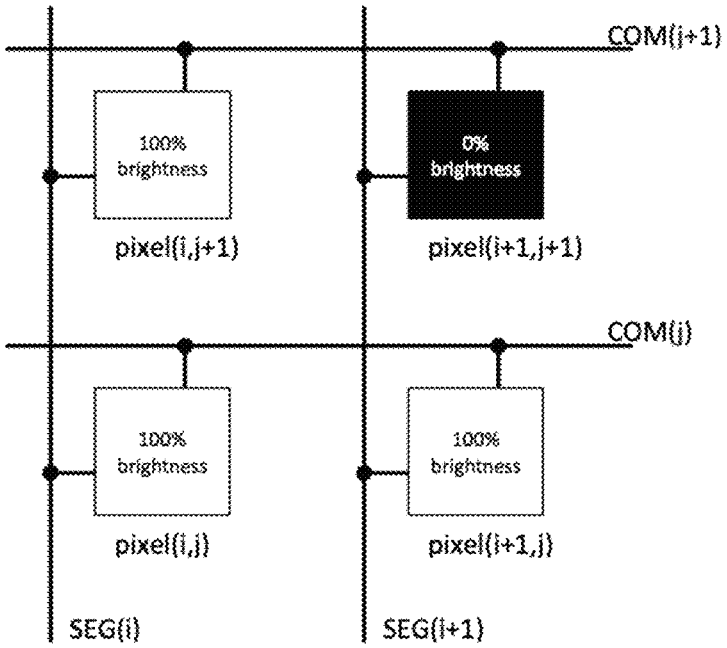
FIG. 2b – Prior Art

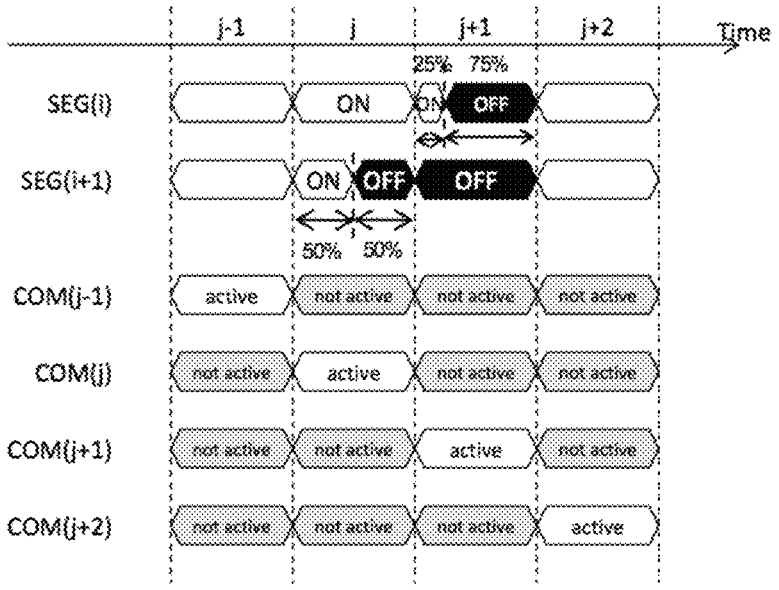
FIG. 3a – Prior Art
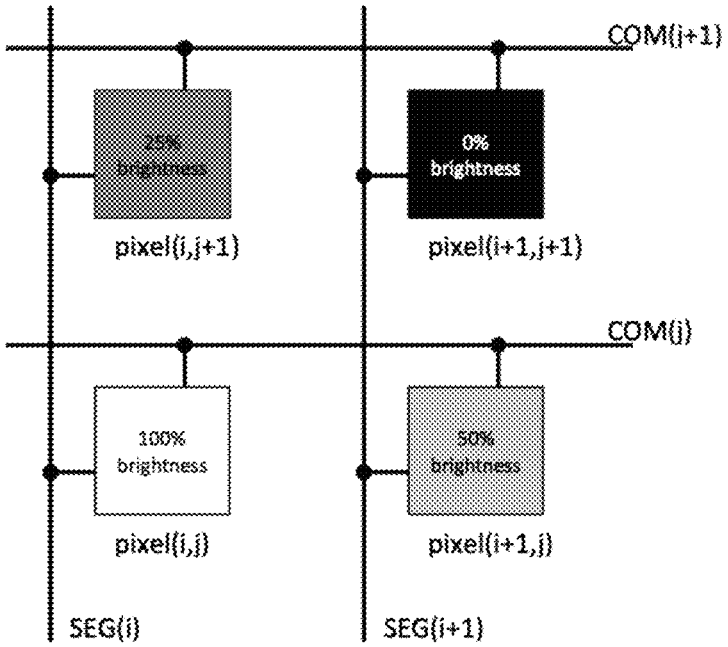
FIG. 3b – Prior Art

METHOD AND APPARATUS OF GRAYSCALE IMAGE GENERATION IN MONOCHROME DISPLAY

FIELD OF THE INVENTION

The present invention is generally related to techniques in driving light-emitting diodes (LEDs), including organic light-emitting diodes (OLEDs), monochrome display to achieve grayscale image effects.

BACKGROUND

In existing monochrome passive matrix OLED (PMOLED) display applications, it is desirable to display, at least for a short period of time, grayscale patterns or images for better visual effect; for example, showing a logo during the device startup. It is not known that there is any existing display driver that has built-in mechanism that provides the aforesaid function. There are, however, commercially available standalone grayscale image display driver or module to provide such function in monochrome PMOLED displays. In general, grayscale image display driver has embedded full size memory and more hardware than monochrome driver. Once grayscale image is stored in the embedded memory, greyscale driver can generate grayscale image itself without extra external control. On the other hand, the working principle of monochrome image display drivers and modules is that display image data is written into the display driver for every frame and the frame-rate-control (FRC) is varied to produce the grayscale image. This involves complex control between the host controller and the display driver, such as signal timing synchronization for preventing tearing effects.

SUMMARY OF THE INVENTION

In accordance to various embodiments of the present invention, a method is provided that allows the use of monochrome PMOLED display driver to generate grayscale patterns without the need to change the resolution of the 1-bit digital-to-analog converter (DAC) on the data line (SEG). The method further allows the elimination of extra frame buffer display memory needed by conventional techniques. This is achieved by swapping display memory space for display image pixel color (grayscale) depth in the expense of display resolution. The method further allows grayscale pattern data to be written into frame buffer only once without additional control from the host controller. The method further allows the dynamic application of grayscale on selectable number of scan lines such that full grayscale image display or a mixture of monochrome and grayscale image display in a single display panel is possible. Furthermore, the present invention may also be adapted to improve a grayscale image display driver such that a conventional grayscale image display driver having n-bit DAC may be enhanced to produce more than $2^n$ grayscale levels.

BRIEF DESCRIPTION OF THE DRAWINGS

Embodiments of the invention are described in more detail hereinafter with reference to the drawings, in which:

FIG. 1*a* depicts a circuit diagram of a pixel in a conventional PMOLED display panel; and FIG. 1*b* depicts the corresponding timing diagram of driving signals on the data lines and scan lines of the conventional PMOLED display panel in accordance to a typical signal driving scheme;

FIG. 2*a* depicts an exemplary timing diagram of driving signals on the data lines and scan lines of a conventional PMOLED display panel in accordance to a typical monochrome-only image generation signal driving scheme; and FIG. 2*b* shows the states of the pixels corresponding to the driving signals shown in FIG. 2*a;*

FIG. 3*a* depicts an exemplary timing diagram of driving signals on the data lines and scan lines of a conventional PMOLED display panel in accordance to a conventional grayscale image generation signal driving scheme; and FIG. 3*b* shows the states of the pixels corresponding to the driving signals shown in FIG. 3*a;*

DETAILED DESCRIPTION OF THE INVENTION

Figure 4A:
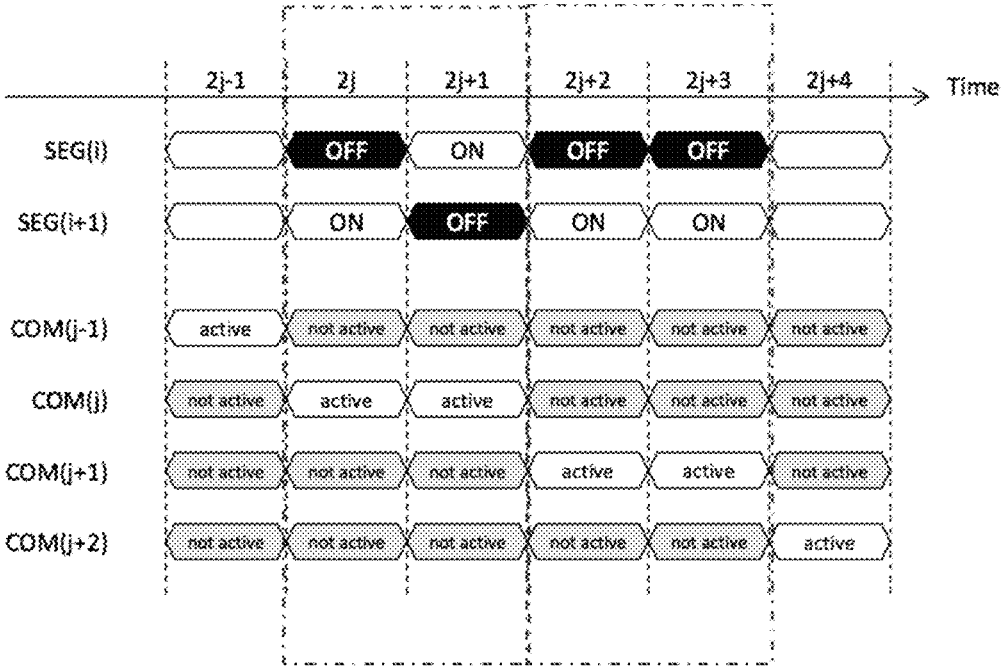
FIG. 4*a* depicts an exemplary timing diagram of driving signals on the data lines and scan lines of a conventional PMOLED display panel in accordance to a grayscale image generation signal driving scheme provided by a first embodiment of the present invention.

In the following description, methods and apparatuses for generating grayscale images in displays and the like are set forth as preferred examples. It will be apparent to those skilled in the art that modifications, including additions and/or substitutions may be made without departing from the scope and spirit of the invention. Specific details may be omitted so as not to obscure the invention; however, the disclosure is written to enable one skilled in the art to practice the teachings herein without undue experimentation.

Referring to FIGS. 1*a* and 1*b* for illustrating the working principle of PMOLED. In a PMOLED display panel, a pixel has the electrical characteristic of a diode. It turns on when the voltage across the pixel is greater than a threshold voltage. The brightness of the pixel is also related to the amount of current passing through the pixel, though the relationship is not linear. However, the brightness of the pixel is nearly linearly proportional to its duty ratio, which is the time duration that it is being turned on. In general, a driving scheme of the PMOLED display panel involves pre-charging the pixel to its threshold voltage via the data line (SEG) in the beginning of each line scan. Thereafter, a current is driven on to the SEG to turn on the pixel.

For a clearer illustration of the present invention, embodiments described herein assume that the parasitic resistance and capacitance in the PMOLED display panel are insignificant. As such, the pre-charging of the pixel can be considered to be zero time and the brightness of a pixel is linearly proportional to the ON time of the pixel within a line scan. In the rest of this document, the term 'monochrome' (or 'mono') means that the DAC on every data line SEG has a 1 bit resolution, and a pixel can only be in either OFF or ON state (though the brightness of pixel can still be controlled by the data line SEG driving signal waveform ON duration (e.g. pulse width) or current amplitude. The term 'grayscale' means that the DAC of every SEG has more than 1 bit resolution; thus, $2^n$ grayscale levels can be achieved by using a n-bit DAC, and the data line SEG is driven by a $2^n$ driving signal waveform patterns to represent $2^n$ brightness in each scan line.

Referring to FIGS. 2*a* and 2*b*. In a conventional monochrome driving scheme, the scan lines (COM's) are activated one by one in different timeslot within a frame (e.g. COM(j) is activated in timeslot j). The state of a pixel on a data line SEG during timeslot j is then depended on the state of that data line SEG. For example, if SEG(i) is driven with an ON waveform during timeslot j, then pixel(i, j) is ON with 100% brightness; if SEG(i+1) is driven with an OFF waveform during timeslot j+1, then pixel(i+1, j+1) is OFF with 0% brightness.

Referring to FIGS. 3*a* and 3*b*. In one conventional grayscale driving scheme, the COM's are activated one by one in different timeslot within a frame (e.g. COM(j) is activated in timeslot j). The state and brightness of a pixel on a data line SEG during timeslot j is then depended on the state and duty ratio of that data line SEG. For example, if SEG(i) is driven with an ON waveform with 100% duty ratio during timeslot j, then pixel(i, j) is ON with 100% brightness; if SEG(i+1) is driven with an ON waveform with 50% duty ratio during timeslot j, then pixel(i+1, j) is ON with 50% brightness; if SEG(i) is driven with an ON waveform with 25% duty ratio during timeslot j+1, then pixel(i, j+1) is ON with 25% brightness; and if SEG(i+1) is driven with an OFF waveform during timeslot j+1, then pixel(i+1, j+1) is OFF with 0% brightness. In this case, each DAC on the SEG can be viewed as having a 2-bit resolution.

The present invention provides methods and apparatuses to enable grayscale image display capability in monochrome display driver having 1-bit DAC's driving the data lines SEG's, without the need for additional memory; thus, having no impact to die size of the display driver integrated circuit (IC). The methods and apparatuses provided can also be adapted to apply to conventional grayscale display drivers to increase color depth as well. The inventive concept is based on the use of T number of bits in memory to represent the grayscale levels for each pixel in the same memory space used for display data in the expense of display resolution. Thus, in order to use T number of bits for grayscale levels for each pixel, the display resolution must decrease by a factor T according to: new display resolution=M×(N/T), where M is maximum number of columns and N is the maximum number of rows in the original display resolution.

The inventive concept is further based on that each scan line COM(j) is activated in multiple timeslots (T number of timeslots) within each frame, where j is between 0 and N−1, N being the total number of scan lines (or maximum number of rows in the original display resolution), and T being equal or less than N. Each pixel(i, j) then is driven by multiple driving signal waveform cycles on the data line SEG(i) within a frame, where i is between 0 and M−1, and M being total number of data lines (or maximum number of columns in the original display resolution). Due to the different ON and OFF states on SEG(i) during different timeslots, which is controlled by the frame buffer, different levels of brightness of pixel(i, j) are achieved. Furthermore, if the driving signal waveform on SEG is identical in each timeslot, then the number of grayscale levels achievable is T+1; and if the driving signal waveform on SEG varies in specific order in different timeslots, then the number of grayscale levels producible is $2^T$.

Figure 4B:
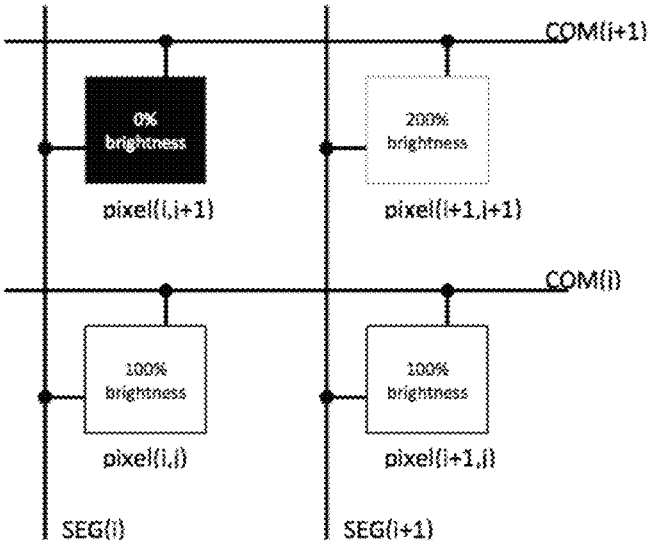
FIG. 4*b* shows the states of the pixels corresponding to the driving signals shown in FIG. 4*a;*

Referring to FIGS. 4*a* and 4*b*. In accordance to a first embodiment of the present invention, provided is a method for achieving a 2-bit 3-level grayscale levels image generation. In this embodiment, each scan line COM(j) is activated during timeslots 2j and 2+1. The state and brightness of pixel(i, j) is then depended on the ON/OFF state of the data line SEG(i) during timeslots 2j and 2+1. For example, if SEG(i) is driven with an OFF waveform during timeslot 2j followed by an ON waveform during timeslot 2+1, then pixel(i, j) is ON with 100% brightness; if SEG(i+1) is driven with an ON waveform during timeslot 2j followed by an OFF waveform during timeslot 2+1, then pixel(i+1, j) is also ON with 100% brightness; if SEG(i) is driven with an OFF waveform during timeslot 2+2 followed by an OFF waveform during timeslot 2+3, then pixel(i, j+1) is OFF with 0% brightness; and if SEG(i+1) is driven with an ON waveform during timeslot 2+2 followed by an ON waveform during timeslot 2+3, then pixel(i+1, j+1) is ON with 200% brightness.

Figure 5A:
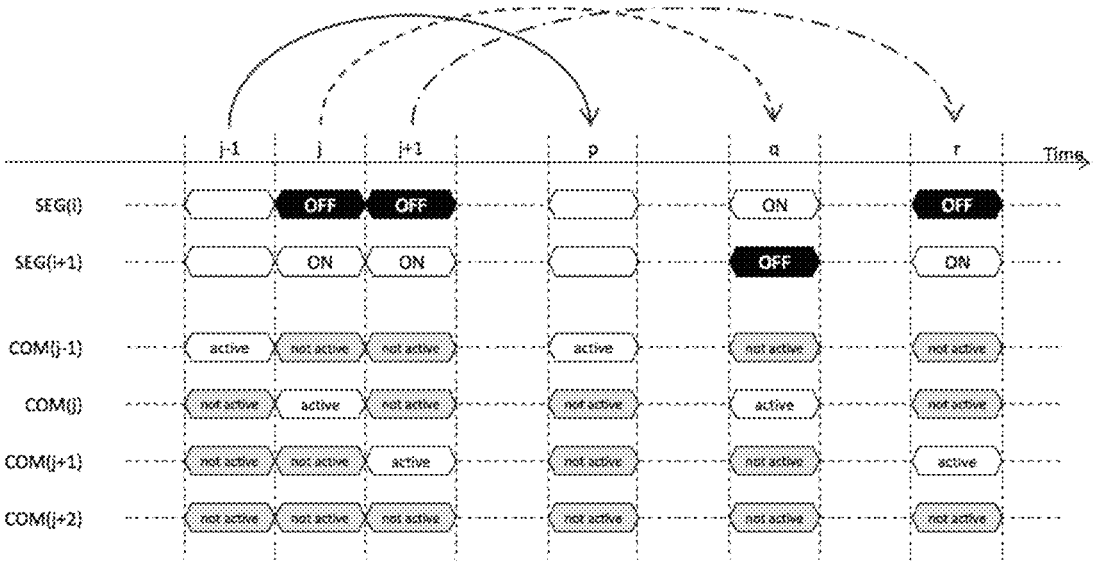
FIG. 5*a* depicts an exemplary timing diagram of driving signals on the data lines and scan lines of a conventional PMOLED display panel in accordance to a grayscale image generation signal driving scheme provided by a second embodiment of the present invention.
Figure 5B:
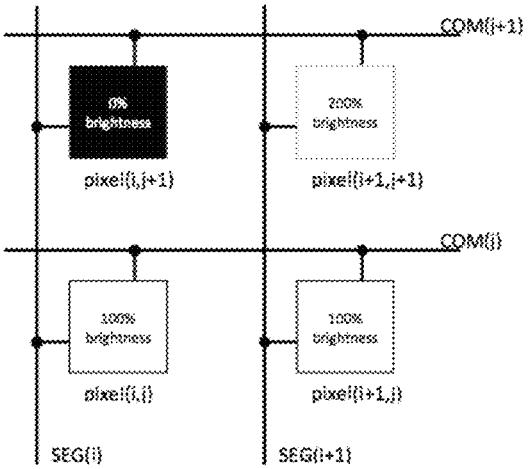
FIG. 5*b* shows the states of the pixels corresponding to the driving signals shown in FIG. 5*a;*

Referring to FIGS. 5*a* and 5*b*. In accordance to a second embodiment, which is a derivation of the first embodiment, the same 2-bit 3-level grayscale levels image generation can be achieved by activating each scan line COM(j) during a plurality of arbitrary timeslots. For example, scan line COM(j−1) is activated in timeslot j−1 followed by timeslot p, scan line COM(j) is activated in timeslot j followed by timeslot q, and scan line COM(j+1) is activated in timeslot j+1 followed by timeslot r, instead of being activated in consecutive timeslots 2j and 2j +1. In both first and second embodiments, the pixel brightness (or gray level) is still determined by the total time duration, or number of timeslots with ON waveform driven on the SEG to a pixel within a defined period of time.

Figure 6A:
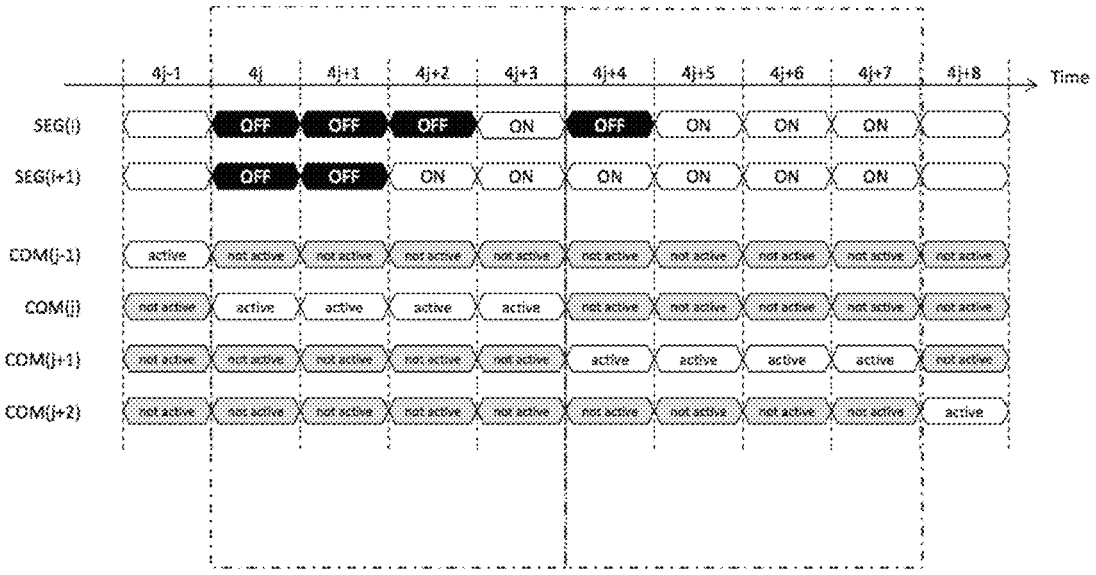
FIG. 6*a* depicts an exemplary timing diagram of driving signals on the data lines and scan lines of a conventional PMOLED display panel in accordance to a grayscale image generation signal driving scheme provided by a third embodiment of the present invention.
Figure 6B:
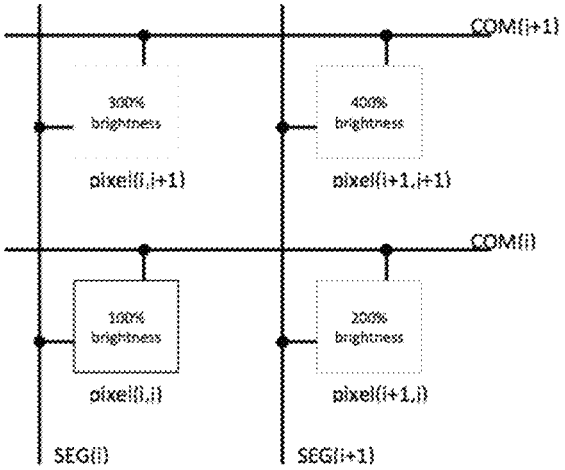
FIG. 6*b* shows the states of the pixels corresponding to the driving signals shown in FIG. 6*a;*

Referring to FIGS. 6*a* and 6*b*. In accordance to a third embodiment, in order to achieve more number of grayscale level, each of the scan lines COM(j) is to be activated in more number of timeslots than in the last two embodiments. For example, to achieve 4-bit 5-levels of grayscale levels, a scan line COM(j) can be activated during timeslots 4j, 4j+1, 4j+2, and 4j+3. The state and brightness of pixel(i, j) is then depended on the ON/OFF state of the data line SEG(i) during timeslots 4j, 4j+1, 4j+2, and 4j+3. For example, if SEG(i) is driven with an OFF waveform during timeslot 4j, followed by an OFF waveform during timeslot 4j+1, followed by an OFF waveform during timeslot 4j+2, and followed by an ON waveform during timeslot 4j+3, then pixel(i, j) is ON with 100% brightness; if SEG(i+1) is driven with an OFF waveform during timeslot 4j, followed by an OFF waveform during timeslot 4j+1, followed by an ON waveform during timeslot 4j+2, and followed by an ON waveform during timeslot 4j+3, then pixel(i+1, j) is ON with 200% brightness; if SEG(i) is driven with an OFF waveform during timeslot 4j+4, followed by an ON waveform during timeslot 4j+5, followed by an ON waveform during timeslot 4j+6, and followed by an ON waveform during timeslot 4j+7, then pixel(i, j+1) is ON with 300% brightness; and if SEG(i+1) is driven with an ON waveform during timeslot 4j+4, followed by an ON waveform during timeslot 4j+5, followed by an ON waveform during timeslot 4j+6, and followed by an ON waveform during timeslot 4j+7, then pixel(i+1, j+1) is ON with 400% brightness.

Figure 7A:
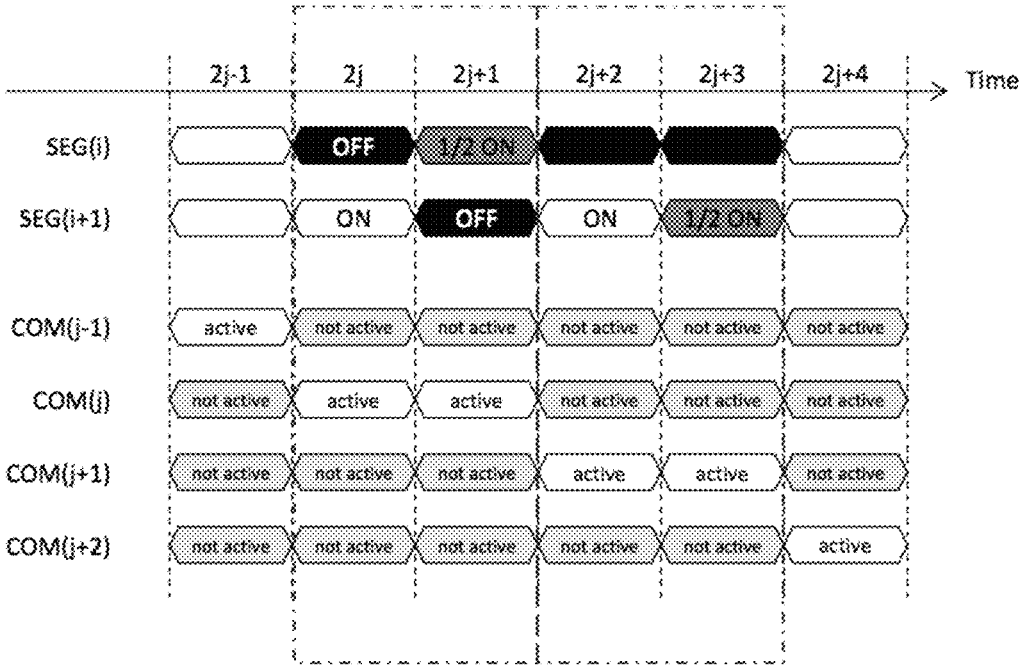
FIG. 7*a* depicts an exemplary timing diagram of driving signals on the data lines and scan lines of a conventional PMOLED display panel in accordance to a grayscale image generation signal driving scheme provided by a fourth embodiment of the present invention.
Figure 7B:
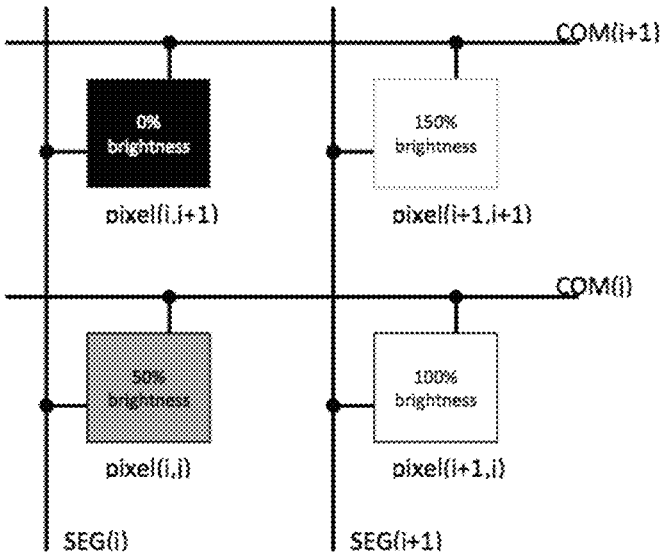
FIG. 7*b* shows the states of the pixels corresponding to the driving signals shown in FIG. 7*a;*

Referring to FIGS. 7*a* and 7*b*. In accordance to a fourth embodiment, provided is a method for achieving a 2-bit 4-level grayscale levels image generation. In this embodiment, each scan line COM(j) is activated during timeslots 2j and 2j+1. Different from the first embodiment in that the driving signal waveform of an ON state driven on to a data line SEG during the odd (or even) timeslots has a 50% duty ratio or a reduced current level corresponding to a 50% pixel brightness. This can be regarded as a half-ON (as opposed to full-ON) state. Thus, during the odd (or even) timeslots, a data line SEG can be driven by either a signal waveform of an OFF state or a signal waveform of a half-ON state, while the other timeslots have the data line SEG driven by either a signal waveform of an OFF state or a signal waveform of a full-ON state. For example, if SEG(i) is driven with an OFF waveform during timeslot 2j, followed by a half-ON waveform during timeslot 2j+1, then pixel(i, j) is ON with 50% brightness; if SEG(i+1) is driven with a full-ON waveform during timeslot 2j, followed by an OFF waveform during timeslot 2j+1, then pixel(i+1, j) is ON with 100% brightness; if SEG(i) is driven with an OFF waveform during timeslot 2j+2, followed by another OFF waveform during timeslot 2j+3, then pixel(i, j+1) is OFF with 0% brightness; and if SEG(i+1) is driven with a full-ON waveform during timeslot 2j+2, followed by a half-ON waveform during timeslot 2j+3, then pixel(i+1, j+1) is ON with 150% brightness.

Figure 8A:
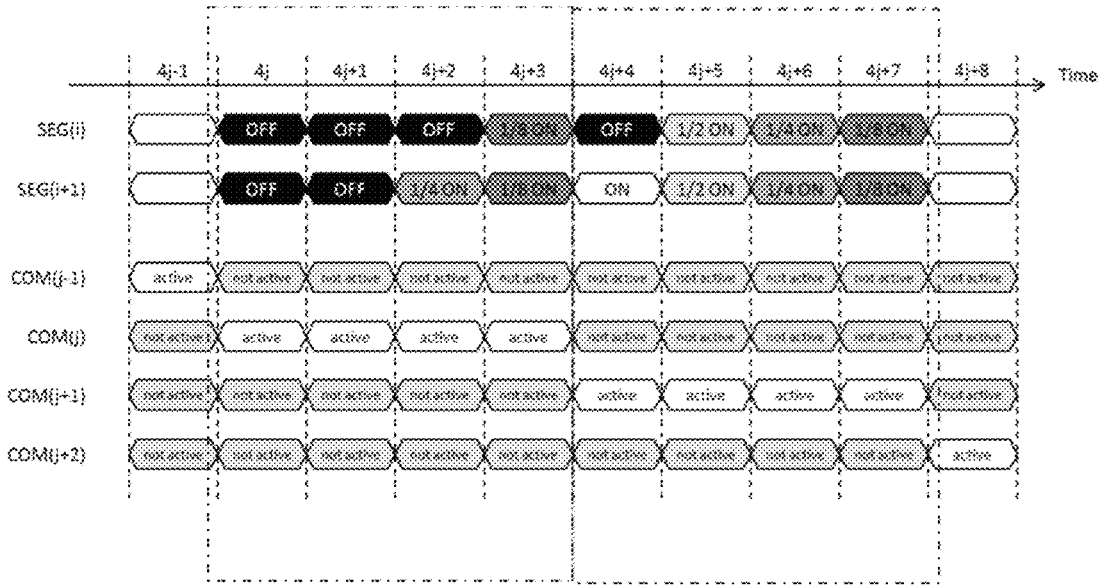
FIG. 8*a* depicts an exemplary timing diagram of driving signals on the data lines and scan lines of a conventional PMOLED display panel in accordance to a grayscale image generation signal driving scheme provided by a fifth embodiment of the present invention.
Figure 8B:
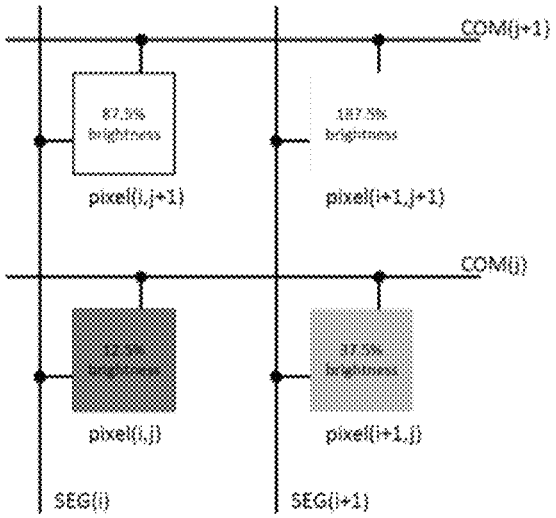
FIG. 8*b* shows the states of the pixels corresponding to the driving signals shown in FIG. 8*a;*

Referring to FIGS. 8*a* and 8*b*. In accordance to a fifth embodiment, provided is a method for achieving a 4-bit 16-level grayscale levels image generation. In this fifth embodiment, the driving signal waveforms of ON state driven on a data line SEG during timeslots 4j+k, where k=0, 1, 2, 3, 4, 5, 6, and 7, have a 100% duty ratio or an unreduced current level corresponding to a 100% pixel brightness (full-ON), a 50% or a reduced current level corresponding to a 50% pixel brightness (half-ON), a 25% or a reduced current level corresponding to a 25% pixel brightness (¼-ON), a 12.5% or a reduced current level corresponding to a 12.5% pixel brightness (⅛-ON), a 100% duty ratio or an unreduced current level corresponding to a 100% pixel brightness (full-ON), a 50% or a reduced current level corresponding to a 50% pixel brightness (half-ON), a 25% or a reduced current level corresponding to a 25% pixel brightness (¼-ON), and a 12.5% or a reduced current level corresponding to a 12.5% pixel brightness (⅛-ON) respectively. This provides 16 possible pixel brightness levels ranging from 0% to 187.5% with increments of 12.5%. For example, if SEG(i) is driven with an OFF waveform during timeslot 4j, followed by an OFF waveform during timeslot 4j+1, followed by an OFF waveform during timeslot 4j+2, and followed by a ⅛-ON waveform during timeslot 4j+3, then pixel(i, j) is ON with 12.5% brightness; if SEG(i+1) is driven with an OFF waveform during timeslot 4j, followed by an OFF waveform during timeslot 4j+1, followed by a ¼-ON waveform during timeslot 4j+2, and followed by a ⅛-ON waveform during timeslot 4j+3, then pixel(i+1, j) is ON with 37.5% brightness; if SEG(i) is driven with an OFF waveform during timeslot 4j+4, followed by a half-ON waveform during timeslot 4j+5, followed by a ¼-ON waveform during timeslot 4j+6, and followed by a ⅛-ON waveform during timeslot 4j+7, then pixel(i, j+1) is ON with 87.5% brightness; and if SEG(i+1) is driven with a full-ON waveform during timeslot 4j+4, followed by a half-ON waveform during timeslot 4j+5, followed by a ¼-ON waveform during timeslot 4j+6, and followed by a ⅛-ON waveform during timeslot 4j+7, then pixel(i+1, j+1) is ON with 187.5% brightness.

Figure 9:
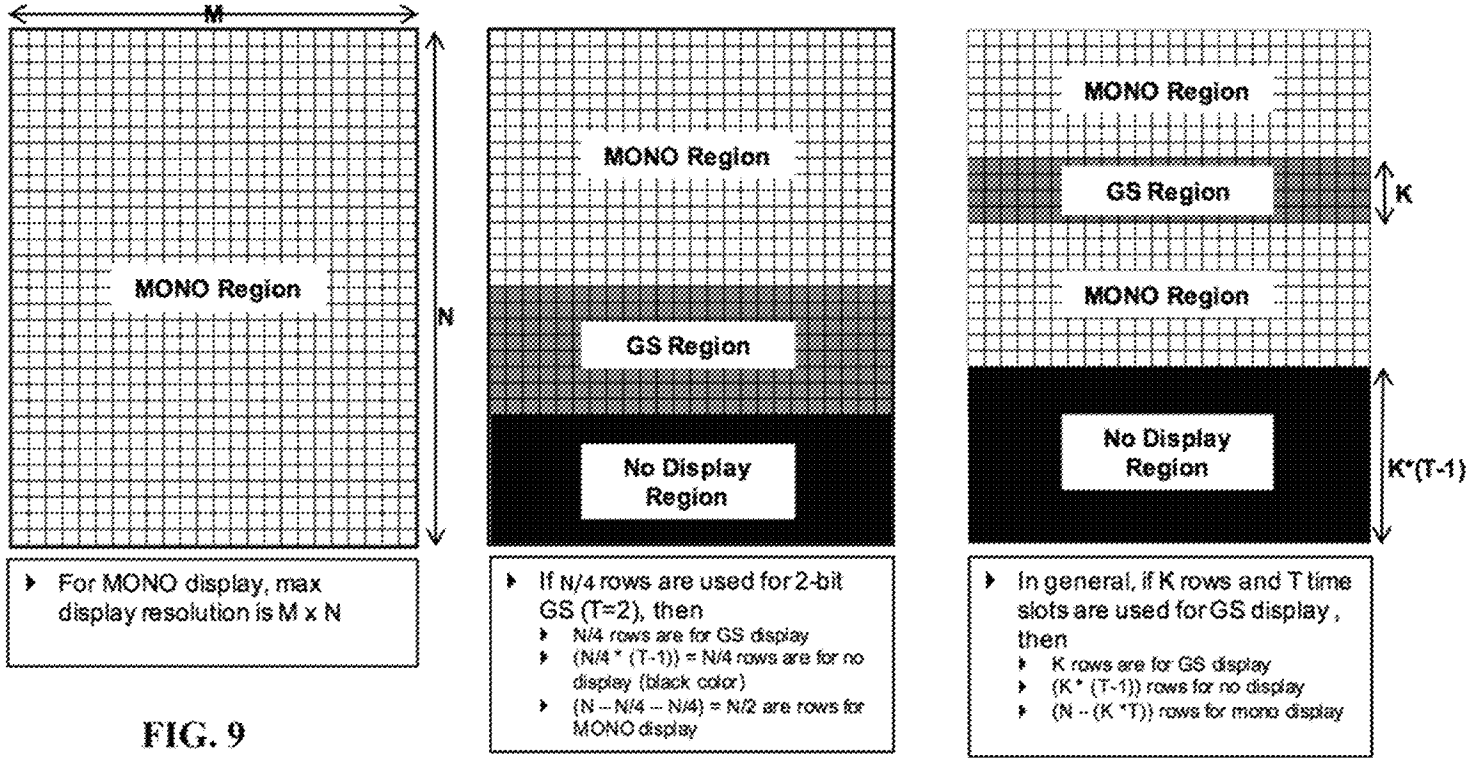
FIG. 9 illustrates one mixture of monochrome and grayscale image display in a single display panel provided by various embodiment of the present invention.

Referring to FIG. 9. In any of the embodiments described above, the grayscale image may not need to occupy the entire screen of the PMOLED display panel. It is possible to configure to dedicate a portion of screen to grayscale image display and the rest monochrome image display. Since certain memory space is needed for the grayscale image pixel color depth (gray level) information, assuming no additional display memory is used, a portion of the display memory must be reserved for the grayscale image pixel color depth information. This portion of reserved display memory cannot be used for image display, resulting in a no-display region in the PMOLED display panel. Further assuming that the PMOLED display panel has a resolution of M columns by N rows. If K number of rows are used for the grayscale image display, and that T number of timeslots are used for the gray scale level generation (T number of bits), then (K*(T−1)) number of rows belong to no-display region, and (N−(K*T)) number of rows can be used for monochrome image display.

Figure 10:
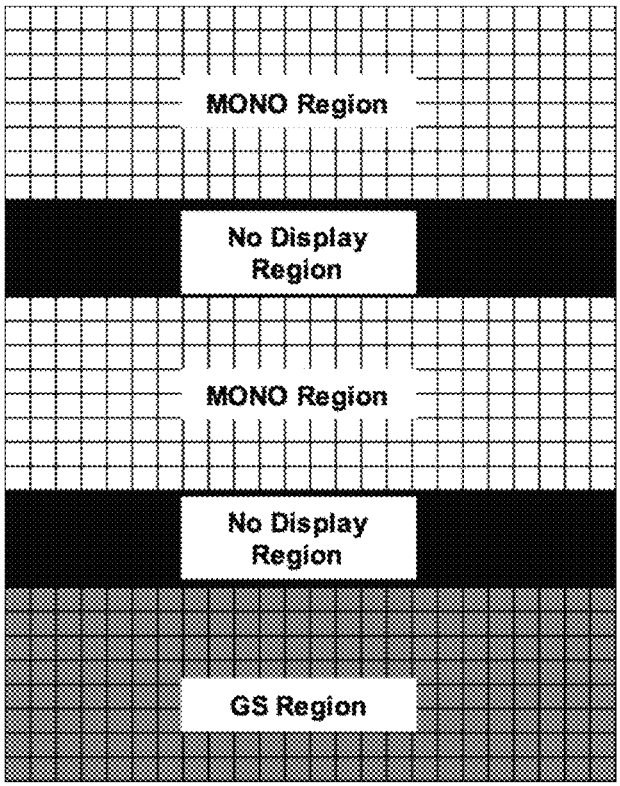
FIG. 10 illustrates another mixture of monochrome and grayscale image display in a single display panel provided by various embodiment of the present invention.

Referring to FIG. 10. The portion of reserved display memory for storing the grayscale image pixel color depth information can be split into multiple parts corresponding to multiple areas selectively distributed throughout a PMOLED display panel. This allows the viewer to perceive a full PMOLED display panel displaying both the monochrome image(s) and grayscale image(s) instead of a shrank PMOLED display panel having a noticeable no-display region due to the reserved display memory for storing the grayscale image pixel color depth information.

Figure 11A:
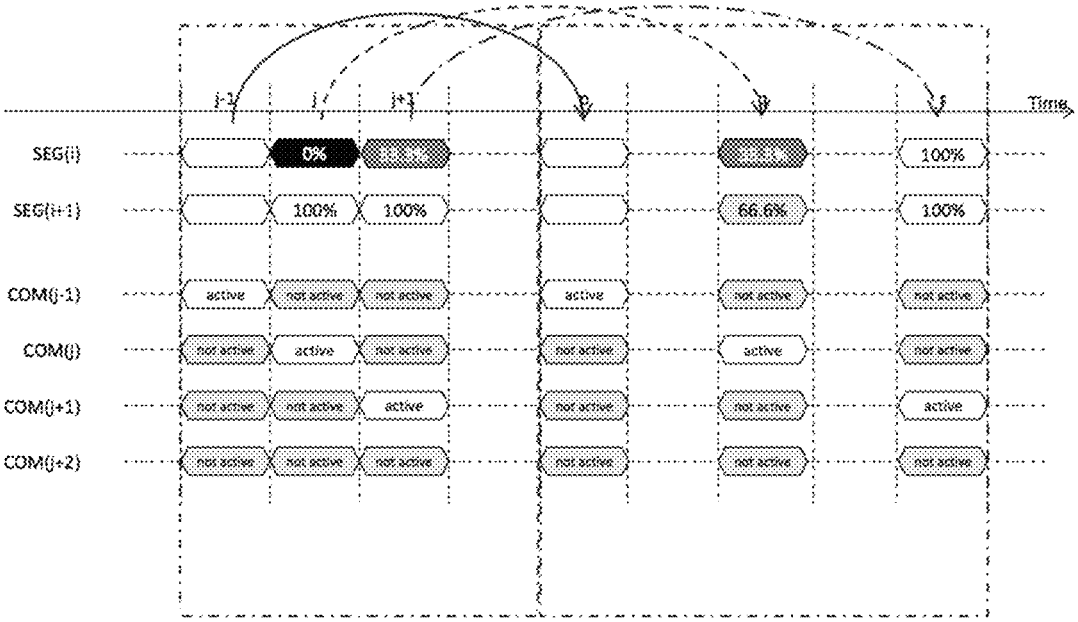
FIG. 11*a* depicts an exemplary timing diagram of driving signals on the data lines and scan lines of a conventional PMOLED display panel in accordance to a grayscale image generation signal driving scheme provided by one embodiment of the present invention adapted to a 2-bit grayscale image display driver.
Figure 11B:
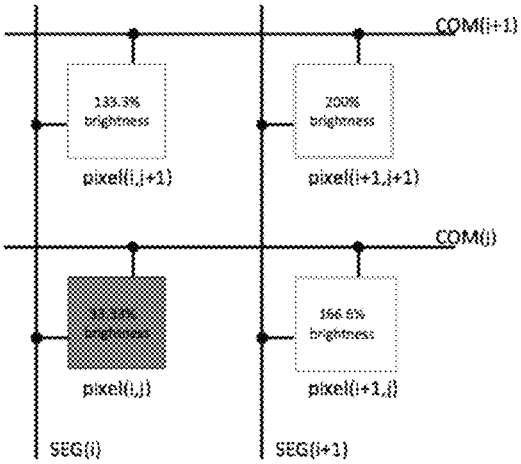
FIG. 11*b* shows the states of the pixels corresponding to the driving signals shown in FIG. 11*a*.

The present invention may also be adapted to improve a grayscale image display driver. Recall that the principle behind a grayscale image display driver is that each data line SEG is driven by one of $2^n$ driving signal waveform patterns representing $2^n$ brightness in each scan line. In the exemplary embodiment corresponding to FIGS. 11*a* and 11*b*, the original unimproved grayscale image display driver has a 2-bit DAC, thus capable of producing four pixel gray levels at 0%, 33.3%, 66.6%, and 100% brightness. Applying the technique of the present invention to this grayscale image display driver, each scan line COM(j) is activated in multiple timeslots (T number of timeslots) within each frame (T=2 in this exemplary embodiment). The result is that the possible different gray levels for a pixel now depend on the sum of the different SEG driving signal waveform patterns during the multiple COM active timeslots within each frame. The maximum number of gray level is then equal to: (Y−1)*T+1, where Y is the number of original gray levels producible, and T is the number of timeslots within each frame in which a scan line COM can be activated. In this exemplary embodiment, Y is equal to four (4) and T is equal to two (2), thus a total of seven (7) gray levels are producible at 0%, 33.3%, 66.6%, 100%, 133.3%, 166.6%, and 200% brightness.

Figure 12A:
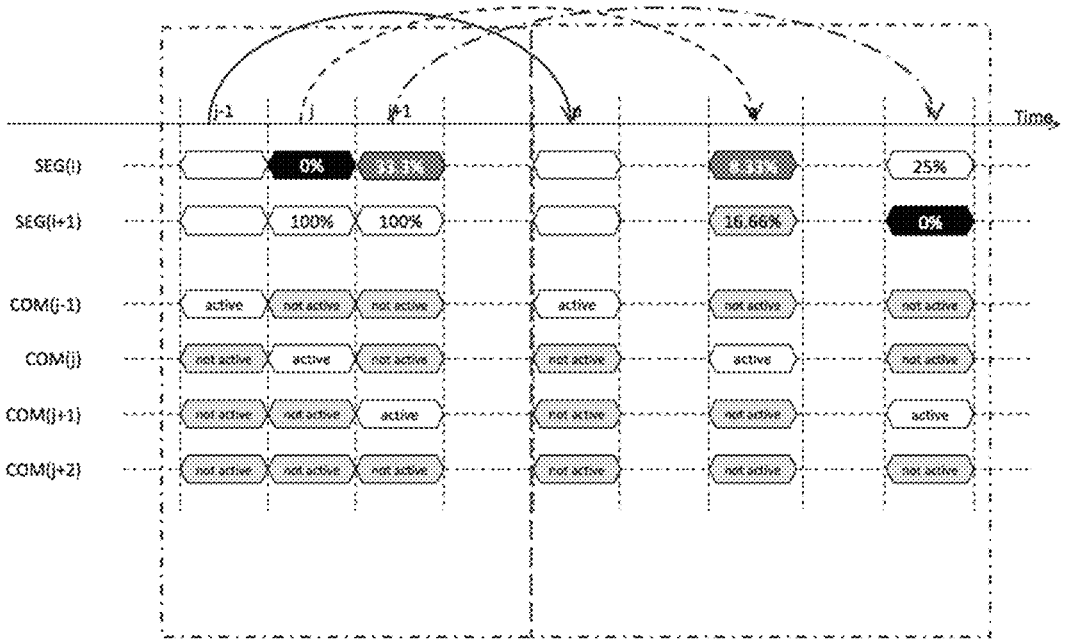
FIG. 12*a* depicts an exemplary timing diagram of driving signals on the data lines and scan lines of a conventional PMOLED display panel in accordance to a grayscale image generation signal driving scheme provided by another one embodiment of the present invention adapted to a 2-bit grayscale image display driver.
Figure 12B:
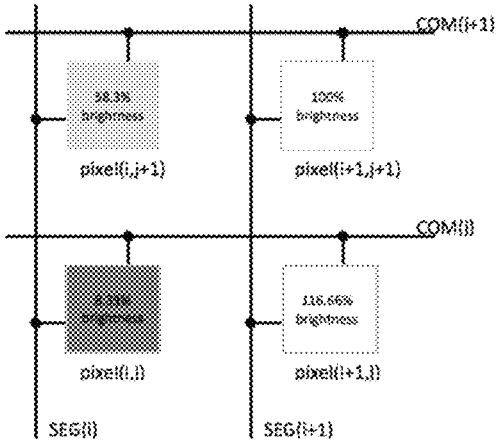
FIG. 12*b* shows the states of the pixels corresponding to the driving signals shown in FIG. 12*a*.

Referring to FIGS. 12*a* and 12*b*. In another embodiment of adaptation of the present invention to a grayscale image display driver, each scan line COM(j) is activated in two timeslots within each frame. One of the timeslots (odd or even) is dedicated for allowing each data line SEG to be driven by one of $2^n$ driving signal waveform patterns representing $2^n$ brightness producible by the original unimproved grayscale image display driver. With Y being the number of originally producible gray levels, the possible pixel gray levels corresponding to these odd or even timeslots are: 0%, 1/(Y−1)*100%, 2/(Y−1)*100%, . . . , (Y−1)/(Y−1)*100% brightness. The other one of the timeslots (even or odd) is dedicated for allowing each data line SEG to be driven by one of the $2^n$ driving signal waveform patterns having a shorten duty ratio or a reduced current level (magnitudes divided by a factor of Y). With Y being the number of originally producible gray levels, the possible pixel gray levels corresponding to these odd or even timeslots are: 0%, 1/(Y−1)/Y*100%, 2/(Y−1)/Y*100%, . . . , (Y−1)/(Y−1)/Y*100% brightness. The result is that the possible different gray levels for a pixel now depend on the sum of the different SEG driving signal waveform patterns during the multiple COM active timeslots within each frame, and the maximum number of gray levels is equal to: $Y^T$, where Y is the number of original gray levels producible, and T is the number of timeslots within each frame in which a scan line COM can be activated. In this exemplary embodiment where the number of original gray levels producible, Y, is equal to four (4), and T is equal to two (2), the maximum number of gray levels producible is sixteen (16) at: 0%, 8.33%, 16.66%, 25%, 33.33%, 41.66%, 50%, 58.33%, 66.66%, 75%, 83.33%, 91.66%, 100%, 108.33%, 116.66%, and 125% brightness.

Although the foregoing embodiments of multiple-phase constant current topology are applied in OLED lighting, an ordinarily skilled person in the art would appreciate that the same inventive concept can be applied in other lighting applications, such as those with LEDs.

The embodiments disclosed herein may be implemented using general purpose or specialized computing devices, computer processors, or electronic circuitries including but not limited to digital signal processors (DSP), application specific integrated circuits (ASIC), field programmable gate arrays (FPGA), and other programmable logic devices configured or programmed according to the teachings of the present disclosure. Computer instructions or software codes running in the general purpose or specialized computing devices, computer processors, or programmable logic devices can readily be prepared by practitioners skilled in the software or electronic art based on the teachings of the present disclosure.

In some embodiments, the present invention includes computer storage media having computer instructions or software codes stored therein which can be used to program computers or microprocessors to perform any of the processes of the present invention. The storage media can include, but are not limited to ROMs, RAMs, flash memory devices, or any type of media or devices suitable for storing instructions, codes, and/or data.

The foregoing description of the present invention has been provided for the purposes of illustration and description. It is not intended to be exhaustive or to limit the invention to the precise forms disclosed. Many modifications and variations will be apparent to the practitioner skilled in the art.

The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the following claims and their equivalence.

What is claimed is:

1. A method of grayscale image display signal driving in a monochrome display panel, comprising:

activating each scan line in T number of timeslots within each frame, wherein only one scan line is activated at any one timeslot; and driving each data line by one of Y number of different driving signal waveforms during each timeslot within each frame, wherein each of the Y number of different driving signal waveforms corresponds to one possible pixel grayscale level, wherein:

brightness of a pixel is determined by a sum of the driving signal waveforms during the activated scan line timeslots driven on a data line connected to the pixel, wherein T and Y are an integer greater than one, respectively;

grayscale image pixel gray level information is stored in a display memory space shared by image display data;

the display memory space is fixed for an original display resolution of the display panel such that the display resolution is decreased to accommodate the grayscale image pixel gray level information being stored in a portion of the display memory space reserved for the grayscale image pixel gray level information; and the portion of the display memory space reserved for the grayscale image pixel gray level information is split into multiple parts corresponding to multiple areas distributed throughout the display panel.

2. The method of claim 1, wherein the activation of each scan line is in T number of consecutive timeslots within each frame.

3. The method of claim 1, wherein the activation of each scan line is in T number of non-consecutive timeslots within each frame.

4. The method of claim 1, wherein;

T is equal to two;

each data line is drived by one of the Y number of different driving signal waveforms during a first timeslot within each frame; and each data line is drived by one of the Y number of different driving signal waveforms having magnitudes divided by a factor of Y during a second timeslot within each frame.

5. The method of claim 4, wherein the activation of each scan line is in T number of consecutive timeslots within each frame.

6. The method of claim 4, wherein the activation of each scan line is in T number of non-consecutive timeslots within each frame.

7. A passive matrix organic light-emitting diodes (PMOLED) display panel comprising a display driver configured to execute the method of claim 4.

8. A passive matrix organic light-emitting diodes (PMOLED) display panel comprising a display driver configured to execute the method of claim 1.

9. The method of claim 1, wherein;

the Y number of different driving signal waveforms are ON or OFF driving signal waveform cycles; and brightness of a pixel is determined by total number of timeslots having ON driving signal waveform cycles driven on the data line connected to the pixel.

10. The method of claim 9, wherein all ON driving signal waveform cycles have identical signal waveform duty ratio and current amplitude.

11. The method of claim 10, wherein the activation of each scan line is in T number of consecutive timeslots within each frame.

12. The method of claim 10, wherein the activation of each scan line is in T number of non-consecutive timeslots within each frame.

13. A passive matrix organic light-emitting diodes (PMOLED) display panel comprising a display driver configured to execute the method of claim 10.

14. The method of claim 9, wherein the ON driving signal waveform cycles vary, in terms of signal waveform duty ratio or current amplitude, in specific order in different timeslots.

15. The method of claim 14, wherein the activation of each scan line is in T number of consecutive timeslots within each frame.

16. The method of claim 14, wherein the activation of each scan line is in T number of non-consecutive timeslots within each frame.

17. A passive matrix organic light-emitting diodes (PMOLED) display panel comprising a display driver configured to execute the method of claim 14.

* * * * *